US005952974A

United States Patent [19]

Ito et al.

[11] Patent Number: 5,952,974

[45] Date of Patent: Sep. 14, 1999

[54] ANTENNA ASSEMBLY AND PORTABLE RADIO APPARATUS

[75] Inventors: Hiroki Ito; Katsumi Hirota, both of Kanagawa; Shinichi Kuroda, Saitama, all of Japan

[73] Assignee: Sony Corporation, Tokyo, Japan

[21] Appl. No.: 08/807,274

[22] Filed: Feb. 28, 1997

[30] Foreign Application Priority Data

Mar. 5, 1996 [JP] Japan ..... 8-075222

[51] Int. Cl.[6] ..... H01Q 1/24

[52] U.S. Cl. ..... 343/702; 343/895

[58] Field of Search ..... 343/702, 895, 343/900, 901; H01Q 1/24

[56] References Cited

U.S. PATENT DOCUMENTS 5,661,495 8/1997 Saldell ..... 343/725

5,731,791 3/1998 Jang ..... 343/702

5,825,330 10/1998 Na et al. ..... 343/900

*Primary Examiner*—Hoanganh Le

*Attorney, Agent, or Firm*—Jay H. Maioli

[57] ABSTRACT

A mono-pole antenna is composed of a first element and a second element. An insulator spacer is disposed between the first element and the second element so as to capacitively couple them. In the state that the antenna is retracted, the helical antenna operates. In the state that the antenna is extended, the mono-pole antenna composed of the first element and the second element operates. Since the mono-pole antenna is composed of the first element and the second element that are capacitively coupled, even if the electrical length of the helical antenna is different from the electrical length of the mono-pole antenna, the impedances can be properly matched with a common matching circuit.

12 Claims, 3 Drawing Sheets

ANTENNA ASSEMBLY AND PORTABLE RADIO APPARATUS

BACKGROUND OF THE INVENTION

1. Field of the Invention

The present invention relates to an antenna apparatus suitable for a small portable radio unit, in particular, to an antenna apparatus that operates as a mono-pole antenna in its extended state and as a helical antenna in its retracted state.

2. Description of the Related Art

Portable radio units such as portable telephone terminals and PHS (Personal Handyphone System) terminals have been become common. These portable radio units have been developed so as to improve the performance, user interface, and portability. To satisfy such requirements, high density LSI devices and high power batteries are used so as to reduce the size and weight thereof.

Such portable radio units each have a telescopic antenna that can be freely extended and retracted. In an early-staged portable radio unit, before the user uses it, he or she should extend the antenna. The antenna is a simple whip antenna that operates as for example a $\lambda/4$ ($\lambda$ is wavelength) mono-pole antenna in the extended state. However, when a portable radio unit is used, the antenna is not always extended. Some users may communicate with their parties in the state that the antennas are retracted. In addition, when the portable radio units are not used, their antennas are always retracted. Thus, it is necessary to consider the dynamic characteristics of the antennas in the retracted state. In the case of a simple whip antenna, when the antenna is retracted, since the antenna is disposed in the vicinity of a grounded conductor, the input impedance increases. Thus, since the impedances are not matched, a sufficient gain cannot be obtained.

To improve the gain of an antenna in the retracted state, a top loading type antenna of which a helical portion is connected to a top portion of the whip antenna is used. In the case of this antenna, when the antenna is extended, the combined portion of the whip antenna and the helical portion operates as a top loading type mono-pole antenna. When the antenna is retracted, only the top helical portion operates as a helical antenna. Thus, in the state that the antenna is retracted, the gain thereof is improved.

However, this antenna has a mono-pole antenna portion that does not radiate radio waves in the retracted state. This portion operates as an open stub that adversely affects the input impedance of the antenna. This portion delicately disturbs the matching state depending on the distance with a circuit board in the portable radio unit. Thus, the operating characters of such an antenna are not high. In addition, when the portable radio unit is not properly shielded, the mono-pole antenna that is retracted collects signals. Alternatively, signals enter the inside of the portable radio unit.

To solve such a problem, an antenna that has a mono-pole antenna and a helical antenna that operate depending on whether the antenna is extended or retracted has been developed. In this antenna, since the mono-pole antenna and the helical antenna separately operate, they do not interfere with each other. Thus, a sufficient gain can be obtained regardless of whether the antenna is extended or retracted.

FIGS. 1A and 1B are sectional views showing the above-described antenna. In FIGS. 1A and 1B, reference numeral 101 is a case. The case 101 is composed of a non-metal material. The case 101 houses a circuit board 102 necessary for a portable radio unit. The circuit board 102 includes an RF transmitting/receiving circuit 103.

The case 101 has an antenna mounting hole 104. A case mounting metal fastener 105 fits with the antenna mounting hole 104. The case mounting metal fastener 105 is electrically connected to an antenna matching circuit 107 through an antenna feeder spring 106. The antenna matching circuit 107 is disposed so as to match the impedances of the RF transmitting/receiving circuit 103 and the mono-pole antenna or the helical antenna.

Reference numeral 112 is an antenna cover composed of an insulator. An upper metal fastener 113 fits with an upper portion of the antenna cover 112. A lower metal fastener 114 fits with a lower portion of the antenna cover 112. A helical antenna portion 111 is disposed between the upper metal fastener 113 and the lower metal fastener 114. An upper portion of the helical antenna portion 111 is electrically connected to the upper metal fastener 113. A lower portion of the helical antenna portion 111 is electrically connected to the lower metal fastener 114.

A hole 115 is formed at an upper center portion of the antenna cover 112. Holes 116 and 117 are formed at a center portion of the upper metal fastener 113 and a center portion of the lower metal fastener 114, respectively. The upper hole 115 of the antenna cover 112, the hole 116 of the upper metal fastener 113, and the hole 117 of the lower metal fastener 114 form a through-hole of the case 101. A mono-pole antenna portion 121 is slidably inserted into the through-hole. An antenna cover 123 composed of an insulator is disposed at an upper portion of the mono-pole antenna portion 121. A top portion 123A of the antenna cover 123 operates as an antenna retracting stopper and an antenna extending knob. An antenna extending stopper 124 composed of a metal material is disposed at a lower portion of the mono-pole antenna 123.

As shown in FIG. 1A, when the antenna is retracted, the mono-pole antenna portion 121 is held in the unit. At this point, the insulator antenna cover 123 disposed on the mono-pole antenna portion 121 contacts the upper metal fastener 113 and the lower metal fastener 114. Thus, only the helical antenna portion 111 operates as for example $\lambda/4$ helical antenna. Since the antenna cover 123 is composed of an insulator, the RF transmitting/receiving circuit 103 is insulated from the mono-pole antenna portion 121. Thus, the mono-pole antenna portion 121 does not operate.

As shown in FIG. 1B, when the antenna is extended, the mono-pole antenna portion 121 is protruded from the unit. In the state that the antenna is extended, the antenna extending stopper 124 fits with the upper metal fastener 113 and the lower metal fastener 114. Thus, the mono-pole antenna portion 121 is kept in the extended state. Since the antenna extending stopper 124 is composed of a conductor, when it contacts the upper metal fastener 113 and the lower metal fastener 114, both ends of the helical antenna portion 111 are short-circuited. Thus, the helical antenna portion 111 does not operate. The RF transmitting/receiving circuit 103 is connected to the antenna extending stopper 124 through the antenna matching circuit 107, the antenna feeder spring 106, the case mounting metal fastener 105, and the lower metal fastener 114. In addition, the antenna extending stopper 124 is electrically connected to the mono-pole antenna portion 121. Thus, the combined portion of the mono-pole antenna portion 121 and the antenna extending stopper 124 operates as a $\lambda/4$ mono-pole antenna.

Thus, in the conventional antenna, since different antenna portions independently operate depending on whether the antenna is extended or retracted, good antenna characteristics can be obtained regardless of whether the antenna is retracted or extended.

However, it is said that when the electrical length of a helical antenna is $\lambda/4$, it has the best characteristics. On the other hand, due to an influence of the head of the user of the unit, when the electrical length of the mono-pole antenna is $3\lambda/8$ or $\lambda/2$, it has the best characteristics. Thus, it is possible to design an antenna having a helical antenna with a length of $\lambda/4$ and a mono-pole antenna with a length of $3\lambda/8$ or $\lambda/2$.

However, when the electrical lengths of the antenna portions differ from each other, the structure of the matching circuit should be changed. In the above-described related art reference, when the antenna is retracted, the helical antenna operates. On the other hand, when the antenna is extended, the mono-pole antenna operates. In the related art reference, a common antenna matching circuit is disposed for both the helical antenna and the mono-pole antenna. Since the common antenna matching circuit is disposed, it is difficult to structure an antenna having a helical antenna and a mono-pole antenna with different electrical lengths.

OBJECTS AND SUMMARY OF THE INVENTION

Thus, an object of the present invention is to provide an antenna apparatus that has different antenna portions that independently operate depending on whether the antenna is retracted or extended and that allow impedances to be properly matched even if the antenna portions have different electrical lengths.

The present invention is an antenna assembly, comprising a helical antenna, a mono-pole antenna having a first conductive rod element and a second conductive rod element that are straightly disposed and capacitively coupled, the mono-pole antenna axially extending inside the helical antenna, the mono-pole antenna being movable against the helical antenna, and a selecting means for causing the helical antenna to operate when the first rod element is placed under the helical antenna and for causing only the mono-pole antenna to operate when the first conductive rod element extends over the helical antenna.

The selecting means has a first metal fastener and a second metal fastener connected to the upper and lower ends of the helical antenna, respectively, when the first rod element extends over the helical antenna, the second conductive rod element contacting the first and second metal fasteners so as to electrically short-circuit both the ends of the helical antenna.

The lower end of the first conductive rod element is combined with the upper edge of the second conductive rod member, the dielectric being disposed between the first and second conductive rod members in the combined portion.

Thus, the first and second conductive rod elements are capacitively coupled. Thus, even if the electrical lengths of the first and second conductive rod elements are different from each other, the impedances of these antennas and the RF transmitting/receiving circuit can be properly matched with the common matching circuit.

These and other objects, features and advantages of the present invention will become more apparent in light of the following detailed description of a best mode embodiment thereof, as illustrated in the accompanying drawings.

DETAILED DESCRIPTION OF THE PREFERRED EMBODIMENT

Figure 1A:
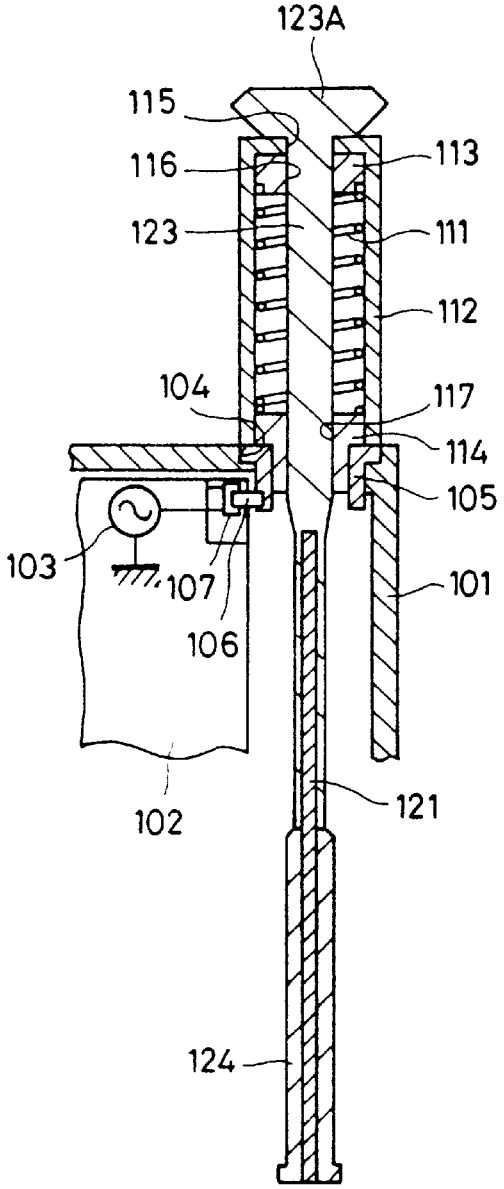
FIGS. 1A and 1B are sectional views for explaining a structure of a conventional antenna.
Figure 1B:
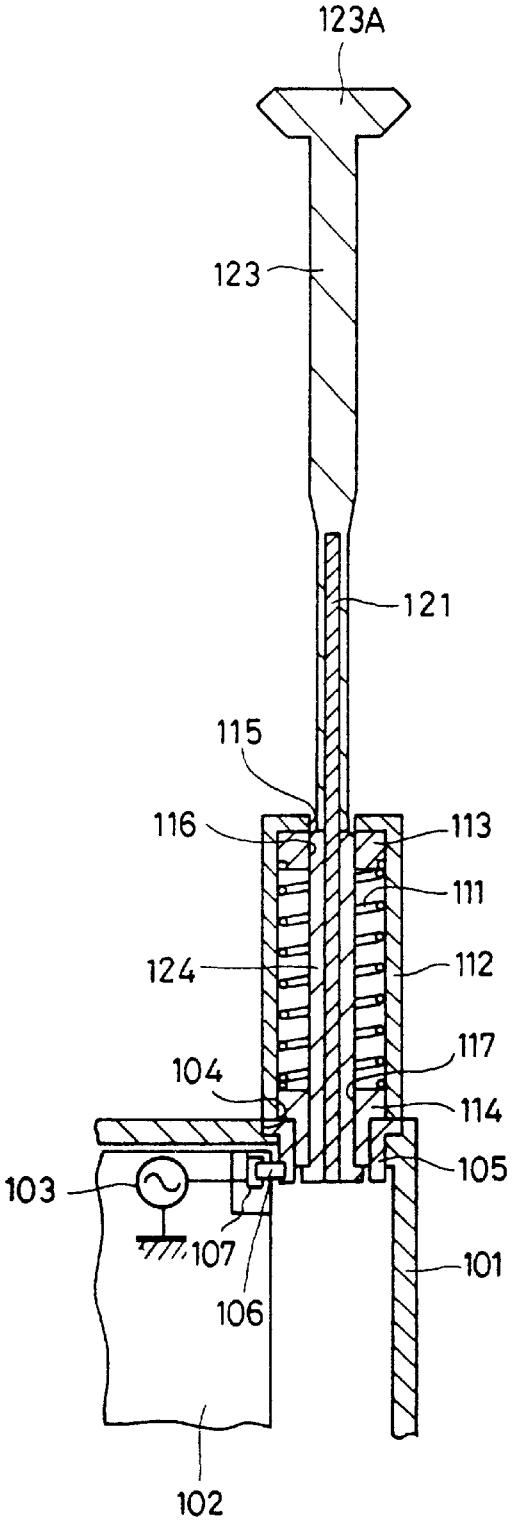
Figure 2A:
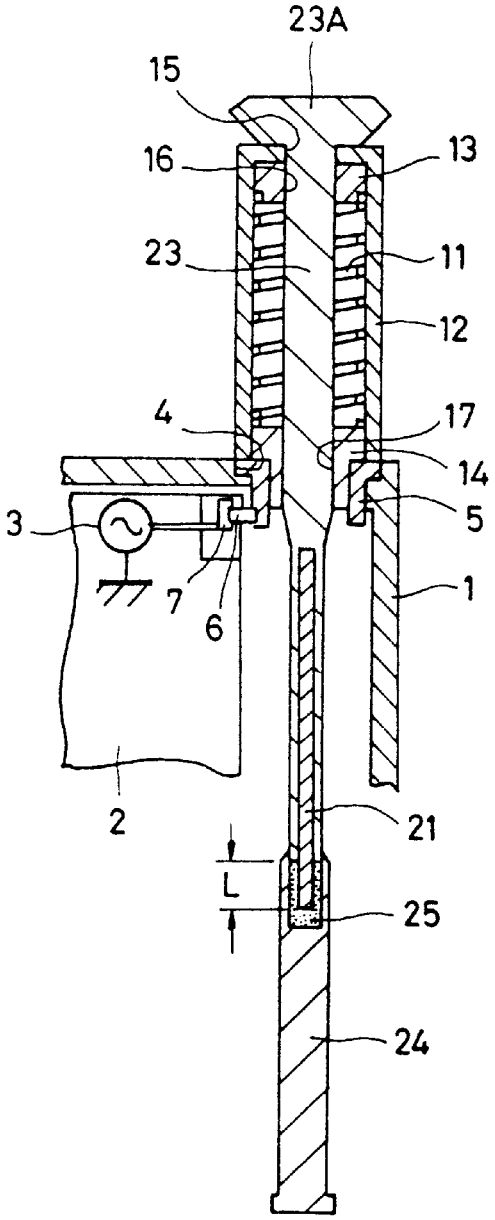
FIGS. 2A and 2B are sectional views for explaining a structure of an antenna according to the present invention.
Figure 2B:
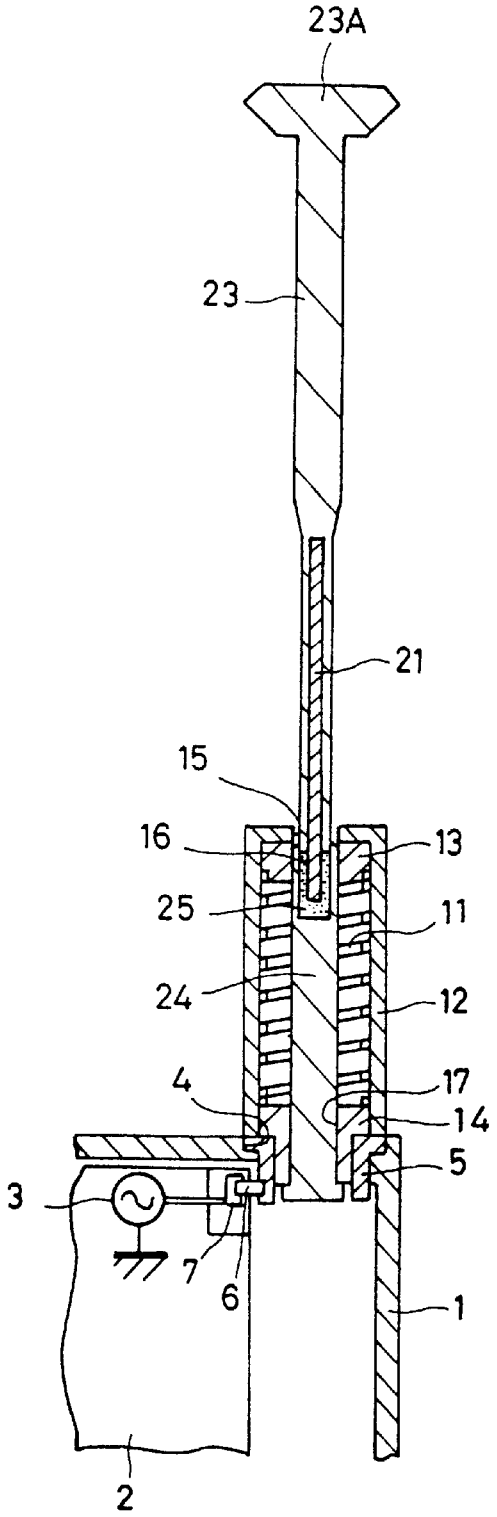

Next, with reference to the accompanying drawings, an embodiment of the present invention will be described. FIGS. 2A and 2B are sectional views showing an antenna according to the present invention. The antenna is used for a portable telephone terminal. In FIGS. 2A and 2B, reference numeral 1 is a case. The case 1 is composed of a non-metal material. The case 1 houses a circuit board 2 necessary for a portable radio unit. The circuit board 2 has various functional circuits. The circuit board 2 includes an RF transmitting/receiving circuit 3.

An antenna mounting hole 4 is formed in the case 1. A case mounting metal fastener 5 fits with the antenna mounting hole 4. The case mounting metal fastener 5 is electrically connected to an antenna matching circuit 7 through an antenna feeder spring 6. The antenna matching circuit 7 is used to match the impedances of the RF transmitting/receiving circuit 3 and a helical antenna or a mono-pole antenna.

Reference numeral 12 is an antenna cover composed of an insulator. An upper metal fastener 13 fits with an upper portion of the antenna cover 12. A lower metal fastener 14 fits with a lower portion of the antenna cover 12. A helical antenna portion 11 is disposed between the upper metal fastener 13 and the lower metal fastener 14. The electrical length of the helical antenna portion 11 is $\lambda/4$. An upper portion of the helical antenna portion 11 is electrically connected to the upper metal fastener 13. A lower portion of the helical antenna portion 11 is electrically connected to the lower metal fastener 14.

A hole 15 is formed at an upper center portion of the antenna cover 12. Holes 16 and 17 are formed at a center portion of the upper metal fastener 13 and a center portion of the lower metal fastener 14, respectively. The hole 15 of the antenna cover 12, the hole 16 of the upper metal fastener 13, and the hole 17 of the lower metal fastener 14 form a through-hole of the case 1. A mono-pole antenna portion 21 is slidably inserted into the through-hole.

An antenna cover 23 composed of an insulator is disposed on the mono-pole antenna portion 21. A top portion 23A of the antenna cover 23 operates as an antenna contracting stopper and an antenna extending knob. An antenna extending stopper 24 is disposed at a lower portion of the mono-pole antenna portion 21 through a spacer 25 composed of an insulator such as polycarbonate or ABS resin. Since the spacer 25 is disposed between the mono-pole antenna portion 21 and the antenna extending stopper 24, the spacer 25 operates as a dielectric. Consequently, the mono-pole antenna portion 21 and the antenna extending stopper 24 are capacitively coupled.

FIG. 2A shows the structure of the antenna according to the present invention in the state that the antenna is retracted. As shown in FIG. 2A, when the antenna is retracted, the mono-pole antenna portion 21 is held in the unit. The insulator antenna cover 23 disposed at a top portion of the mono-pole antenna portion 21 contacts the upper metal fastener 13 and the lower fastener 14. Since the antenna cover 23 is composed of an insulator, the RF transmitting/receiving circuit 3 is insulated from the mono-pole antenna portion 21. On the other hand, the RF transmitting/receiving circuit 3 and one end of the helical antenna portion 11 are connected through the antenna matching circuit 7, the antenna feeder spring 6, the case mounting metal fastener 5, and the antenna mounting metal fastener 14. Thus, only the helical antenna 101 operates as a helical antenna with an electrical length of λ/4.

FIG. 2B shows the structure of the antenna according to the present invention in the state that the antenna is extended. As shown in FIG. 2B, when the antenna is extended, the mono-pole antenna portion 21 is protruded from the unit. In the state that the antenna is extended, the antenna extending stopper 24 fits with the upper metal fastener 13 and the lower metal fastener 14. Thus, the antenna is kept in the extended state. Since the antenna extending stopper 24 is composed of a conductor, when it contacts the upper metal fastener 13 and the lower metal fastener 14, both ends of the helical antenna portion 11 are short-circuited. Thus, the helical antenna portion 11 does not operate.

On the other hand, the RF transmitting/receiving circuit 3 and the antenna extending stopper 24 are connected through the antenna matching circuit 7, the antenna feeder spring 6, the case mounting metal fastener 5, and the lower metal fastener 14. The antenna extending stopper 24 and the mono-pole antenna portion 21 are connected through a spacer 25. At this point, the combined portion of the antenna extending stopper 24 and the mono-pole antenna portion 21 operates as a mono-pole antenna.

In the antenna according to the present invention, since the spacer 25 is disposed between the mono-pole antenna portion 21 and the antenna extending stopper 24, the mono-pole antenna portion 21 and the antenna extending stopper 24 are capacitively coupled. Thus, even if the electrical length of the portion that operates as the mono-pole antenna is longer than λ/4 (for example, λ3/8 or λ/2), the impedances can be matched.

Figure 3:
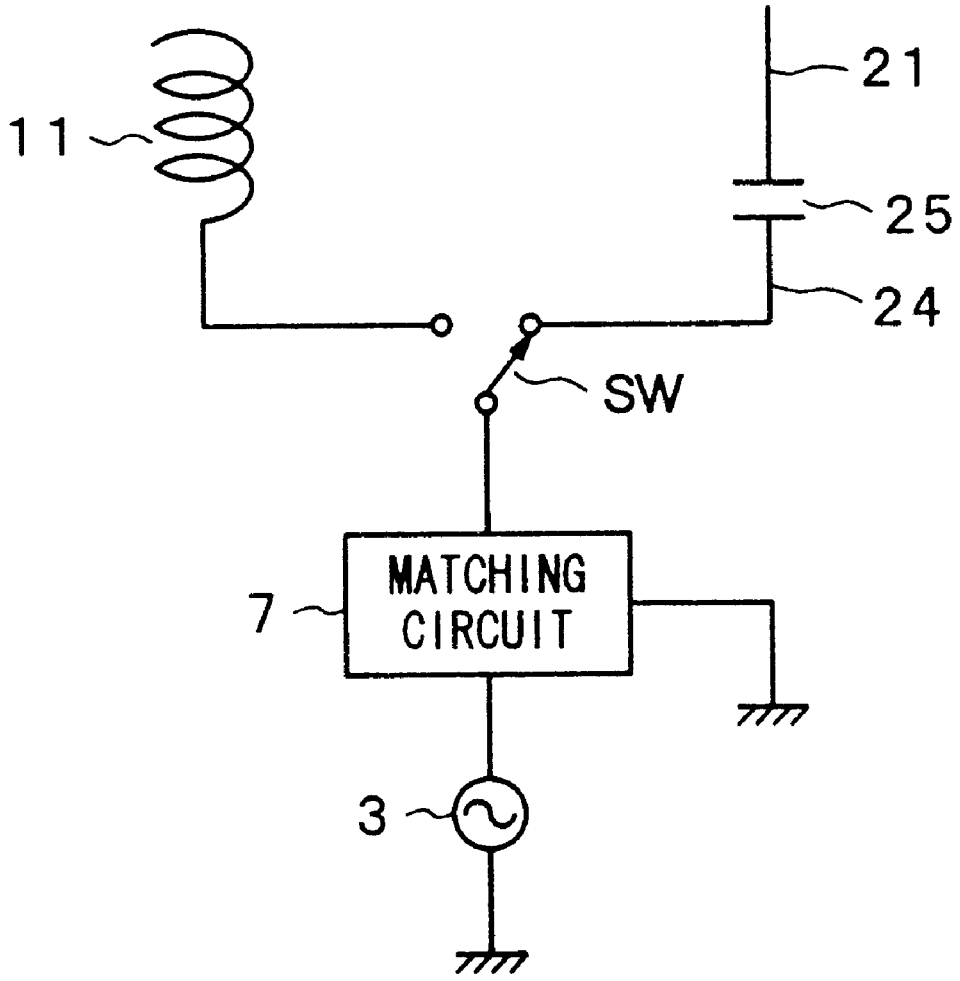
FIG. 3 is an equivalent circuit diagram for explaining the antenna according to the present invention.

FIG. 3 shows an equivalent circuit of the antenna according to the present invention. As described above, the helical antenna or the mono-pole antenna is selectively used depending on whether the antenna is retracted or extended. In the equivalent circuit, the antenna switching portion is denoted by SW. The capacitance caused by the spacer 25 disposed between the mono-pole antenna portion 21 and the stopper 25 is denoted by C.

When the switch SW is placed on the helical antenna side, the helical antenna portion 11 operates as a λ/4 helical antenna. When the switch SW is placed on the mono-pole antenna side, the combined portion of the mono-pole antenna portion 21 and the antenna extending stopper 24 operates as a mono-pole antenna. A capacitor C is disposed in series between the mono-pole antenna portion 21 and the antenna extending stopper 24. Thus, even if the electrical length of the mono-pole antenna is λ3/8 or λ/2, the impedances can be matched.

The capacitance of the capacitor C caused by the spacer 25 disposed between the mono-pole antenna portion 21 and the antenna extending stopper 24 can be freely designated corresponding to the electrical length L of the combined portion of the mono-pole antenna portion 21 and the antenna extending stopper 24. As an example, in the case that the diameter of the mono-pole antenna portion 21 is 0.8 mm, that the length of the antenna extending stopper 24 is 29 mm, that the inner diameter thereof is 2.1 mm, and that the length L of the combined portion of the mono-pole antenna portion 21 and the antenna extending stopper 24 is 5 mm, the impedances can be properly matched at a 800 MHZ band.

In the above-described embodiment, although the case 1 is composed of a non-metal material, it may be composed of a metal material. However, in this case, a spacer or the like should be disposed between the case mounting metal fastener 14 and the metal case 1 so as to insulate them.

In this example, although the mono-pole antenna is a simple rod shaped antenna, it may be a two-staged or multiply-staged antenna.

According to the present invention, in the state that the mono-pole antenna is retracted, the helical antenna operates. In the state that the mono-pole antenna is extended, the mono-pole antenna operates. Thus, the helical antenna and the mono-pole antenna independently operate. Since the mono-pole antenna is capacitively coupled, even if the electrical length of the helical antenna is different from the electrical length of the mono-pole antenna, the impedances can be properly matched with a common matching circuit.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. An antenna assembly, comprising:

a helical antenna having a first electrical length;

a mono-pole antenna having a second electrical length greater than said first electrical length and including:

a first conductive rod element, and a second conductive rod element rigidly attached to said first conductive rod element and capacitively coupled therewith, wherein said mono-pole antenna is adapted to slide inside said helical antenna along a major axis thereof; and selecting means for selecting only said helical antenna to operate when said first conductive rod element is retracted beneath said helical antenna and for selecting only said mono-pole antenna to operate when said first conductive rod element extends over said helical antenna.

2. The antenna assembly as set forth in claim 1, wherein said selecting means includes first and second metal fasteners connected to upper and lower ends of said helical antenna, respectively, and when said first conductive rod element extends over said helical antenna said second conductive rod element short-circuits said first and second metal fasteners so as to electrically short-circuit said helical antenna.

3. The antenna assembly as set forth in claim 1, wherein a non-conductive element is connected to a top of said first conductive rod element of said mono-pole antenna, and when said first conductive rod element is retracted beneath said helical antenna said non-conductive element is housed in said helical antenna so as to support said mono-pole antenna.

4. The antenna assembly as set forth in claim 1, wherein said first and second conductive rod elements are capacitively coupled through a dielectric.

5. The antenna assembly as set forth in claim 4, wherein a bottom of said first conductive rod element is combined with a top of said second conductive rod element forming a capacitor portion, and the dielectric is disposed in said capacitor portion.

6. The antenna assembly as set forth in claim 1, wherein said first electrical length of said helical antenna is λ/4 and said second electrical length of said mono-pole antenna is 3λ/8.

7. The antenna assembly is set forth in claim 1, wherein said first electrical length of said helical antenna is $\lambda/4$ and said second electrical length of said mono-pole antenna is $\lambda/2$.

8. A portable radio apparatus, comprising:

a case;

an antenna assembly including a helical antenna having a first electrical length, a mono-pole antenna having a second electrical length greater than said first electrical length and including a first conductive rod element and a second conductive rod element rigidly attached to said first conductive rod element and capacitively coupled therewith, wherein said mono-pole antenna is adapted to slide inside said helical antenna along a major axis thereof, and selecting means for selecting only said helical antenna to operate when said first conductive rod element is placed under said helical antenna and for selecting only said mono-pole antenna to operate when said first conductive rod element extends over said helical antenna; and feeder means connected to said antenna assembly.

9. The portable radio apparatus as set forth in claim 8, wherein said selecting means includes first and second metal fasteners connected to upper and lower ends of said helical antenna, respectively, and when said first conductive rod element extends over the helical antenna said second conductive rod element short-circuits said first and second metal fasteners so as to electrically short-circuit said helical antenna helical antenna.

10. The portable radio apparatus as set forth in claim 8, wherein a non-conductive element is connected to a top of said first conductive rod element of said mono-pole antenna, and when said first conductive rod element is placed below said helical antenna said non-conductive element is housed in said helical antenna so as to support said mono-pole antenna.

11. The portable radio apparatus as set forth in claim 8, wherein said feeder means has a single impedance matching circuit for use with both antennas.

12. The portable radio apparatus as set forth in claim 8, wherein said feeder means further includes a radio transmitting/receiving circuit.

* * * * *